US007883163B2

(12) United States Patent
Dorner et al.

(10) Patent No.: US 7,883,163 B2
(45) Date of Patent: Feb. 8, 2011

(54) TELESCOPIC RAIL SYSTEM AND A REFRIGERATOR AND/OR FREEZER UNIT

(75) Inventors: Georg Dorner, Steinhausen/Rottum (DE); Werner Schad, Schemmerhofen-Alberweiler (DE); Stefan Rapp, Edelbeuren (DE)

(73) Assignee: Liebherr-Hausgerate Ochsenhausen GmbH, Ochsenhausen (DE)

( * ) Notice: Subject to any disclaimer, the term of this patent is extended or adjusted under 35 U.S.C. 154(b) by 688 days.

(21) Appl. No.: 11/667,088

(22) PCT Filed: Nov. 4, 2005

(86) PCT No.: PCT/EP2005/011835

§ 371 (c)(1),
(2), (4) Date: Nov. 14, 2007

(87) PCT Pub. No.: WO2006/048307

PCT Pub. Date: May 11, 2006

(65) Prior Publication Data

US 2008/0191589 A1 Aug. 14, 2008

(30) Foreign Application Priority Data

Nov. 5, 2004 (DE) ..... 20 2004 017 136 U

(51) Int. Cl.
*A47B 96/04* (2006.01)

(52) U.S. Cl. ..... 312/404; 312/408; 312/334.6

(58) Field of Classification Search ..... 312/404, 312/408, 410, 334.1, 334.6, 334.7, 334.14, 312/334.23, 334.24, 334.27, 334.28
See application file for complete search history.

(56) References Cited

U.S. PATENT DOCUMENTS

| | | | | | |
|---|---|---|---|---|---|
| 2,065,391 | A | | 12/1936 | Nance | |
| 5,486,046 | A | * | 1/1996 | Jernstrom et al. | 312/408 |
| 5,641,217 | A | * | 6/1997 | Caruso et al. | 312/404 |
| 5,848,534 | A | * | 12/1998 | Stauffer | 312/404 |
| 5,980,009 | A | * | 11/1999 | Atalla et al. | 312/408 |
| 6,015,053 | A | * | 1/2000 | Sheng | 312/334.23 |
| 6,148,813 | A | * | 11/2000 | Barnes et al. | 312/408 |
| 6,364,136 | B1 | * | 4/2002 | Weshler et al. | 312/408 |
| 6,394,567 | B1 | * | 5/2002 | Welch | 312/334.41 |
| 6,938,617 | B2 | * | 9/2005 | Le et al. | 312/334.1 |
| 7,171,099 | B2 | * | 1/2007 | Barnes et al. | 312/334.1 |
| 7,216,646 | B2 | * | 5/2007 | Le et al. | 312/410 |
| 2003/0173876 | A1 | * | 9/2003 | Fujii et al. | 312/410 |
| 2003/0173881 | A1 | | 9/2003 | Gomoll et al. | |

FOREIGN PATENT DOCUMENTS

| | | | | |
|---|---|---|---|---|
| DE | 101 40 006 | | 2/2003 | |
| DE | 101 54 275 | | 5/2003 | |
| DE | 103 18 400 | | 12/2003 | |
| DE | 103 04 670 | | 8/2004 | |
| EP | 1460360 | | 9/2004 | |
| JP | 05192232 | A * | 8/1993 | 312/334.1 |
| WO | 00/78187 | | 12/2000 | |
| WO | 02/12810 | | 2/2002 | |

* cited by examiner

*Primary Examiner*—Hanh V Tran
(74) *Attorney, Agent, or Firm*—Dilworth & Barrese LLP

(57) ABSTRACT

A telescopic rail system, in particular for refrigerator units and/or freezer units, has a support plate for the holding the telescopic rail system in the inner compartment of the refrigerator unit and/or freezer unit and two telescopic rails arranged opposite at the support plate in its lateral regions.

21 Claims, 8 Drawing Sheets

TELESCOPIC RAIL SYSTEM AND A REFRIGERATOR AND/OR FREEZER UNIT

BACKGROUND OF THE INVENTION

The invention relates to a telescopic rail system, in particular for refrigerator units and/or freezer units.

In refrigerator units and/or freezer units, drawers are guided in known solutions e.g. on the aluminum evaporator or on a glass plate. The abutment of the drawer takes place via the compartment of the refrigerator unit and/or freezer unit and the drawer itself. Drawers of this type applied to plates cant easily when being pushed in and pulled out. In addition, wear is created at the drawer body.

It is the object of the present invention to provide a telescopic rail system which is very flexible and can be handled simply and reliably. This object is satisfied using a telescopic rail system and refrigerator unit and/or freezer unit having the features herein. Advantageous aspects also form the subject of the invention herein.

The telescopic rail system in accordance with the invention has a support plate for the fixing in the inner compartment of the refrigerator unit and/or freezer unit. Telescopic rails are arranged opposite one another on thee side regions of the support plate. In the pushed together state, these rails have e.g. approximately the length of a side of the support plate. A drawer or a plate which can be pulled out can be placed or set onto the telescopic rails. A sliding on the plate is therefore no longer necessary. The system can nevertheless be used easily since no modifications with respect to conventional solutions are necessary at the inner compartment of the refrigerator unit and/or freezer unit. The telescopic rails are provided on the support plate itself which can be inserted into the unit like a normal shelf plate. In this respect, it is also possible in a simple manner to arrange the element to be pulled out, e.g. the drawer, either above or beneath the support plate. To change the arrangement, the support plate only has to be turned round so that the telescopic rails are no longer arranged on the support plate, but beneath the support plate.

The telescopic rail system in accordance with the invention can be used in a simple manner. The support plate can thus e.g. be supplied to an installation location of the refrigerator unit and/or freezer unit with the telescopic rails pre-assembled.

A reliable pull-out operation is possible by the arrangement of the telescopic rails directly on the support plate. A bulging of the inner space occurs as a rule due to the thermal strain on the body of the refrigerator and/or freezer. A conventional telescopic rail whose one part is firmly fastened in the inner side wall of the unit and whose other part is connected to the pull-out part would cant at such thermal strains. With the solution in accordance with the invention, however, the complete telescopic rail is supported at the support plate itself. Only the support plate itself is held e.g. in rails in the unit without strain. A thermal bulging of the inner space of the refrigerator unit and/or freezer unit therefore does not result in any strain at the telescopic rail which would result in canting.

With a telescopic rail system in accordance with the invention in which the telescopic rails are arranged on a surface of the support plate, the further advantage also results that the support plate can be used as a normal shelf plate by simply being turned around.

The telescopic rails can be fastened to the edge of the support plate. An arrangement of the telescopic rails on the surface of the support plate is particularly advantageous so that the support plate can be pushed into the refrigerator unit and/or freezer unit without hindrance.

In a particular aspect, the telescopic rails are releasably fastened to the support plate. In this manner, the support plate can also be used conventionally as a shelf plate.

The telescopic rails can be fastened to the support plate in a varied manner. In a preferred embodiment, the telescopic rails include, at a first end preferably at the rear in the direction of pulling out, a hook-like element which engages around the support plate and which can be pushed onto the one first edge, preferably the rear edge, of the support plate. The hook-like element secures the telescopic rail against a lifting off from the support plate, on the one hand, and against sliding in the pulling-out direction, on the other hand. A drawer fastened to the telescopic rail can therefore be pulled out without there being any risk of the telescopic rail sliding along.

In the following description, embodiments are described for a simpler representation in which the first edge of the support plate corresponds to the rear edge of the support plate in the refrigerator unit and/or freezer unit. Embodiments are moreover described in which the first end of the telescopic rails corresponds to the end of the telescopic rails at the rear in the pulling-out direction. However, embodiments are equally covered by the scope in which the first edge of the support plate corresponds e.g. to the front edge and the first end of the telescopic rail corresponds e.g. to the end of the telescopic rail at the front in the pulling-out direction.

A hold rail is advantageously provided at the rear edge of the support plate and comes to lie between the hook-like element and the support plate. The holding rail can e.g. be made from plastic or from another material which prevents the direct contact of the telescopic rail or of its hook-like element with the support plate. This is in particular of advantage when the support plate is made of glass and is therefore easier to damage.

Such holding rail can e.g. extend along the total rear edge of the support plate and thus be arranged between the hook-like element of the first telescopic element of the first telescopic rail and the support plate as well as between the hook-like element of the second telescopic rail and the support plate. Such an integral holding piece is simple to fit and is robust. It only has to be pushed onto the rear edge of the support plate once.

The holding rail advantageously has abutments at its ends which contact the side edges of the support plate such that the holding rail is secured against lateral slipping.

Other embodiments have two holding rails which can be pushed onto oppositely disposed ends of the rear edge of the support plate. Such an embodiment requires a lower material effort. Systems with two such holding rails pushed on at the ends of the rear edge of the support plate can also be configured such that the holding rails are secured against slipping with the aid of an abutment at the lateral edge of the support plate.

Provision is made in another embodiment for the support plate to be completely molded around with plastic and for the insert molding to represent a holding rail at a first edge of the support plate, with said holding rail being arranged between the support plate and the respective hook-like element of the respective telescopic rail. Such an embodiment ensures a particularly reliable holding of the holding rail to the support plate.

The holding rail can include a recess facing away from the support plate which is configured such that the telescopic rail comes to lie in this recess in the state pushed onto the holding rail so that the rear end of the telescopic rail is protected against lateral slipping.

Holding elements can be provided at the support plate for the fastening of the telescopic rails and can be fastened to the support plate and serve the holding of the telescopic rails at the support plate. Holding plates can be provided in the front region of the support place specifically with embodiments in which the telescopic rails have a hook-like element at the rear end to engage around the support plate. With such embodiments, the telescopic rail is held at its rear end by the engagement of the hook-like element and of the support plate and at its front end by the holding elements.

In a simple embodiment, the holding elements are adhesively bonded to the support plate. Holding elements are particularly secure which are configured as latch noses which can be inserted into corresponding openings of the support plate. Such holding elements can be clipped onto the support plate very easily. The holding elements can e.g. have abutments which contact the lateral edge of the support plate such that the holding element is secured against lateral slipping.

An alternative embodiment comprises a support plate which is completely molded around with plastic, with this insert molding already including the holding elements. A separate fastening of the holding elements to the support plate is then no longer necessary.

The telescopic rails can be fastened to the support plate using a corresponding number of holding elements. Provision can, however, also be made with an embodiment having holding elements which are integrated into an insert molding of the support plate for the telescopic rails to be hooked in at the rear edge of the support plate using hook-like elements and for only holding elements to be provided for the holding of the front end of the telescopic rails.

Glass is e.g. suitable as the material for the support plate because it has a very low longitudinal coefficient of expansion. No strains occur, or only low strains occur in this manner, even at great temperature differences, which could result in a canting of the telescopic rails.

Support plates which are e.g. made from sheet metal can be equipped with hangers and fastening parts in order likewise to hold telescopic rails.

With support plates which are e.g. made from plastic, preferably as an injection molded part, fastening elements for the telescopic rails can, on the other hand, be directly molded on. With such an injection molded support plate, the rear edge can thus be configured as a holding rail which serves the pushing on of the hook-like element of a correspondingly configured telescopic rail. A holding rail formed integrally with the support plate as an injection molded part can also include a recess facing away from the support plate, with the telescopic rail being received in said recess in the pushed on state such that the end of the telescopic rail is secured against lateral slipping.

Provision is made in a further embodiment for the plastic support plate to include holding elements which are already integrally shaped and which serve the holding of the telescopic rails. The total support plate is here manufactured with all holding elements in one workstep as an injection molded part. In an embodiment of the telescopic rail system in accordance with the invention having telescopic rails which comprise a hook-like element, holding elements are only necessary in the front region of the support plate since the telescopic rails are held by the pushed on hook-like element at the rear edge of the support plate.

The holding element can have projections for the connection of the telescopic rail to the respective holding element which are formed parallel to and spaced apart from the support plate, which face perpendicular to the pulling-out direction of the telescopic rail and which can latch into corresponding openings of the telescopic rails. The projections and the corresponding openings of the telescopic rails can be configured such that they cooperate in the manner of a snap connection. With such an embodiment, specifically with a telescopic rail having a hook-like element for the fastening of the rear end of the telescopic rail to the support plate, the hook-like element of the telescopic rail can first be pushed onto the support plate from the rear. A lateral displacement of the front end of the support plate then effects the latching of the projection into the corresponding opening of the telescopic rail.

In another embodiment, the holding elements have projections parallel to the support plate and face rearwardly in the pulling-out direction and the telescopic rails have corresponding openings. Such an embodiment permits the pushing of the telescopic rail with the hook-like element onto the support plate from the rear with a simultaneous latching of the projection into the corresponding opening of the telescopic rail.

An embodiment in accordance with the invention in which the support plate is insert molded with plastic and the fixed parts of the telescopic rails are injected along therewith for holding at the support plate manages completely without holding elements. Finally, the support plate can also be configured as an injection molded part which integrally includes the fixed parts of the telescopic rails such that the fixed parts of the telescopic rails and the support plate can be manufactured in a single injection molding step.

The telescopic rail system in accordance with the invention can be arranged above or below the support plate depending on whether the pull-out element should be moved above or below the support plate.

BRIEF DESCRIPTION OF THE DRAWINGS

Embodiments of the telescopic rail system in accordance with the invention will be explained in detail with reference to the Figures. There are shown.

DESCRIPTION OF THE PREFERRED EMBODIMENTS

Figure 1:
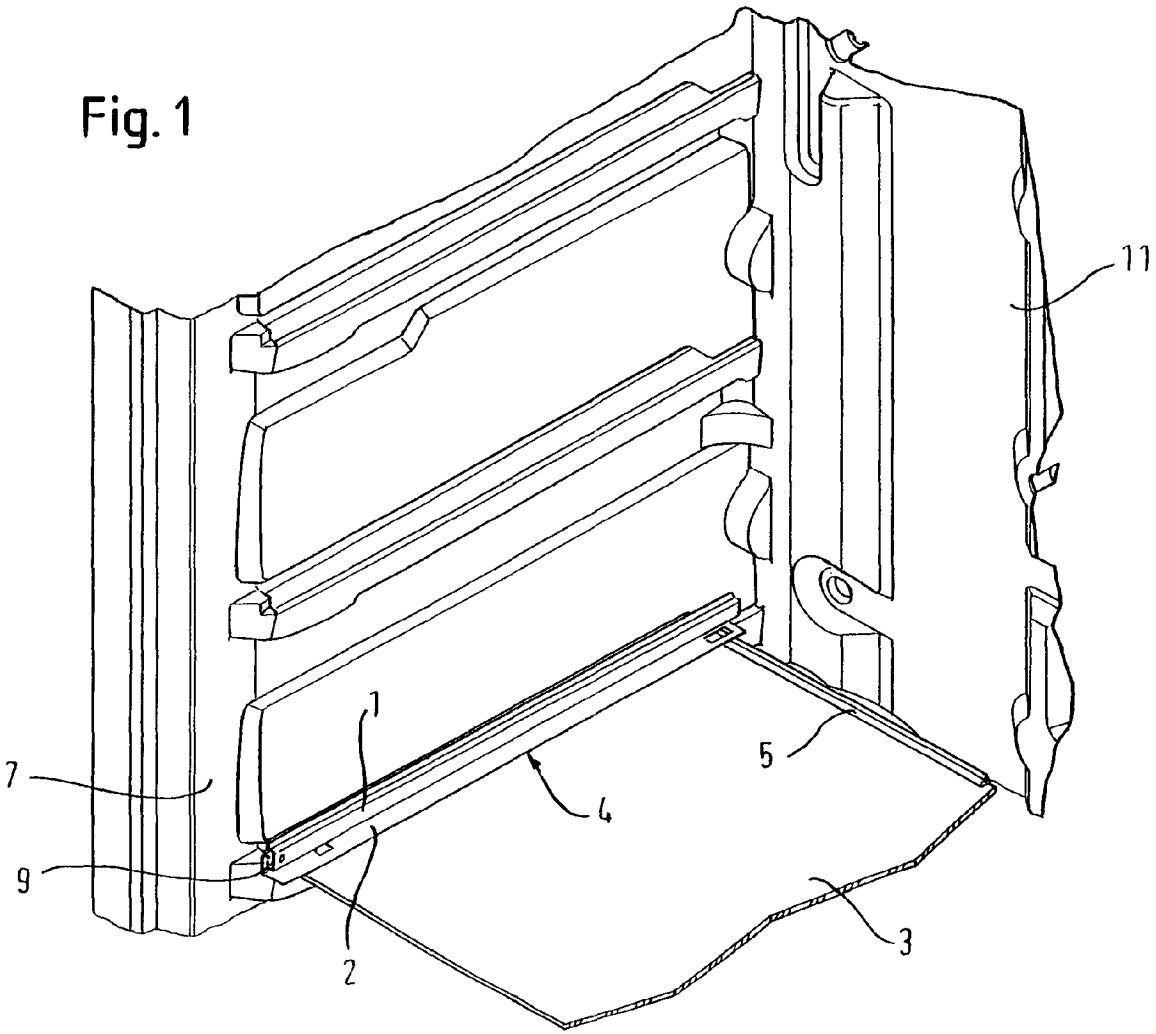
FIG. 1: a partial inner view of a freezer comprising a telescopic rail system in accordance with the invention.

FIG. 1 shows a partial view of the inner region of a fridge/freezer comprising the side wall 7 in which rails 9 are provided. 11 designates the rear wall. A support plate 3 is pushed into the bottommost rail and the lower part 2 of a telescopic rail 4 is fastened thereto. The upper part 1 of the telescopic rail 4 can be pulled out toward the front left in the representation of FIG. 1.

Figure 3:
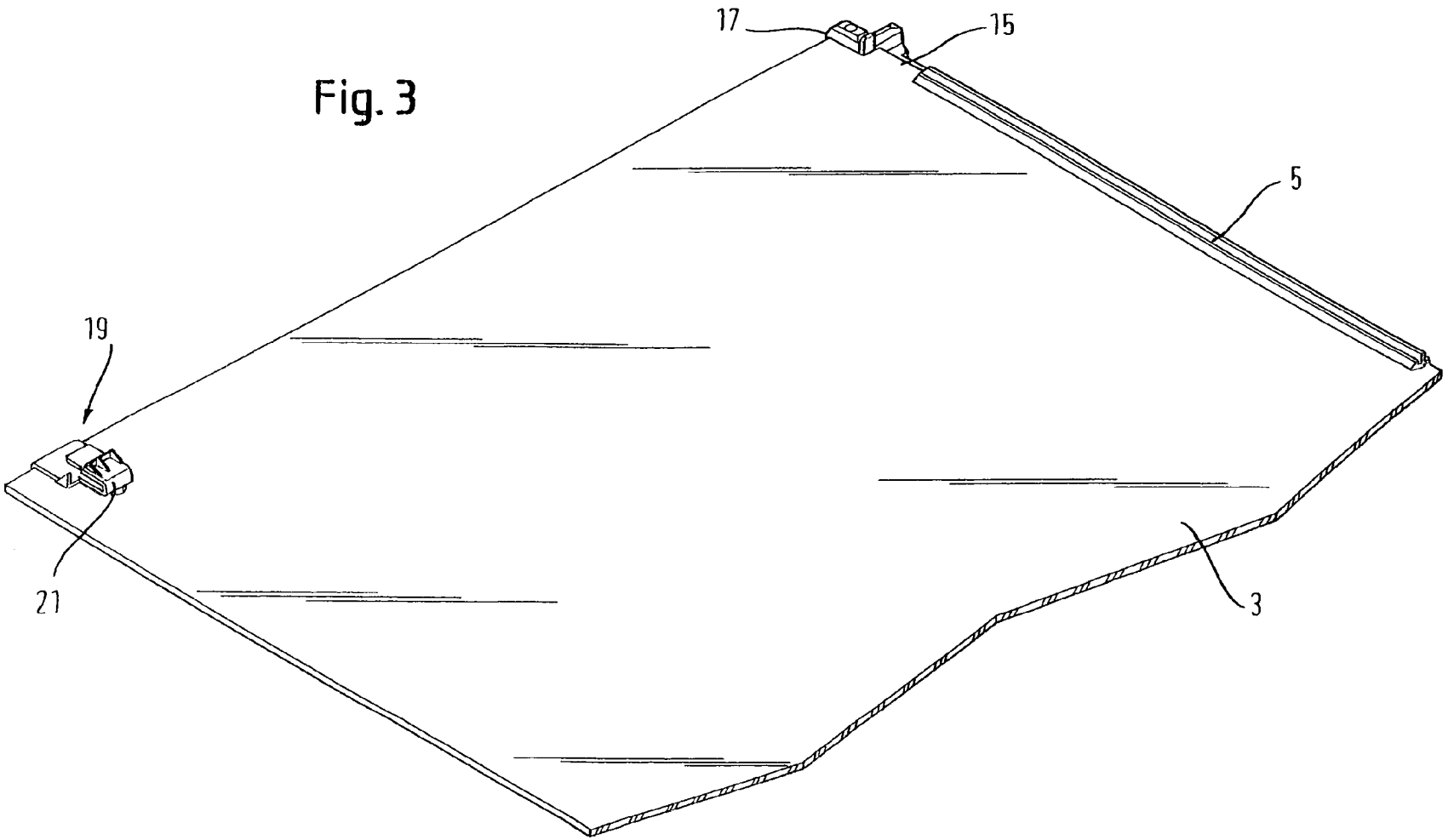
FIG. 3: a partial view of a support plate.

A holding rail 5 made of plastic, which will be explained in detail with reference to FIG. 3, is pushed on at the rear end of the support plate 3 which is made of glass.

Figure 2:
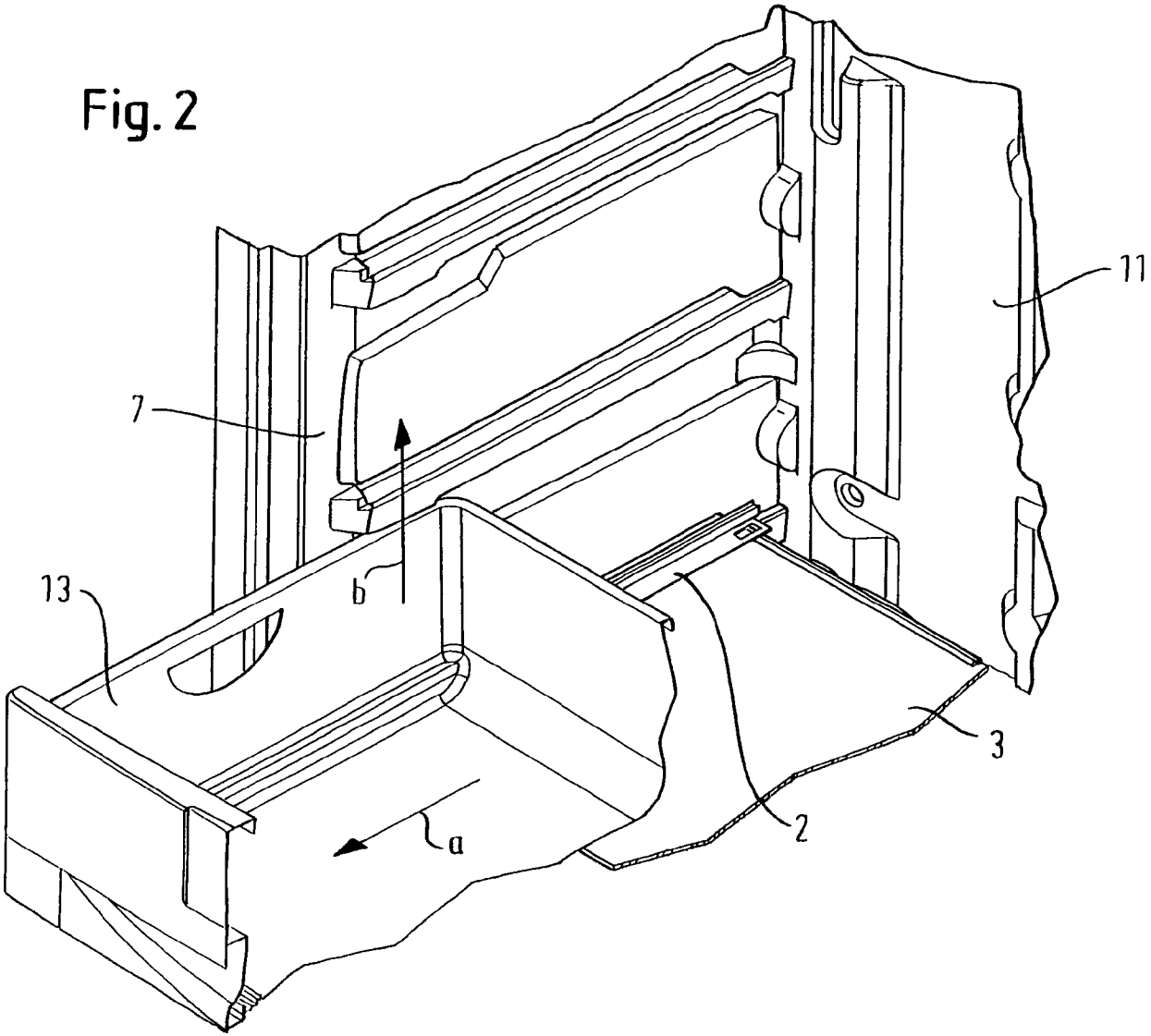
FIG. 2: a partial inner view of a freezer comprising a drawer placed onto the telescopic rail system in accordance with the invention.

FIG. 2 shows the same system with an inserted drawer 13. The drawer 13 is placed on the upper part 1 of the telescopic rail and can therefore be pushed out of the refrigerator and/or freezer in the direction a. The drawer can then be removed in the direction b in the pulled out state.

In FIG. 3, the fastening mechanism for the telescopic rail 4 is shown in detail. A plastic rail 5 is placed on at the rear edge of the glass plate 3 and has a recess 15 in the region of the telescopic rail. The plastic rail 5 is supported at the abutment 17 against the lateral edge of the glass plate 3. In the front region of the glass plate 3, the holding element 19 is placed on which has a projection 21 which is configured as a latch nose, which faces away from the holding element 19 laterally in the pulling-out direction and which is spaced apart from the glass plate. The spacing approximately corresponds to the thickness of the lower part 2 of the telescopic rail 4.

Figure 4:
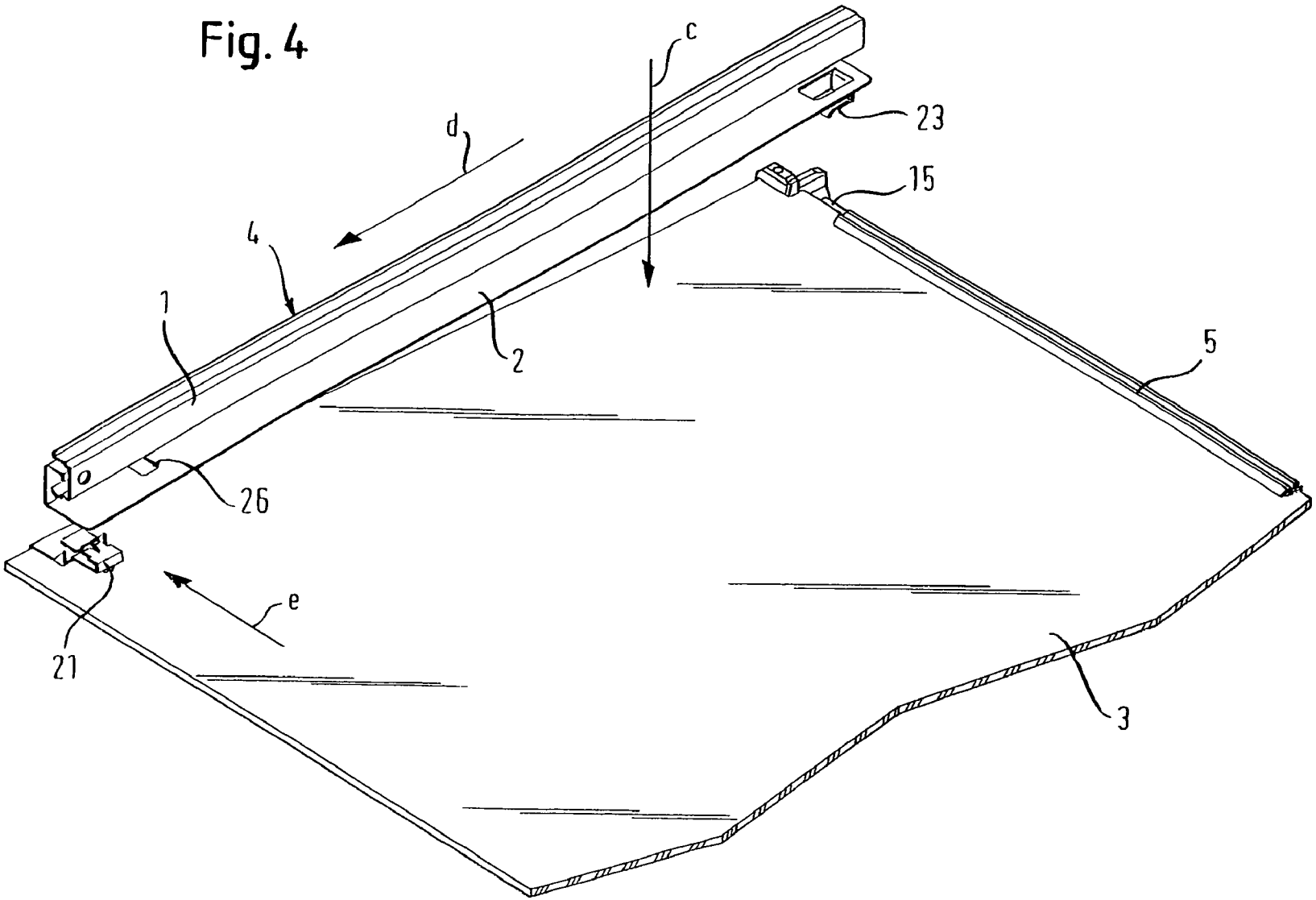
FIG. 4: a telescopic rail system in accordance with the invention during installation.

FIG. 4 explains the installation process of the telescopic rail 4 in the fastening elements. The telescopic rail is first lowered onto the glass plate 3 in the direction c. The hook-like element 23 in the recess 15 of the plastic rail 5 and facing downwardly from the lower part 2 of the telescopic rail 4 is pushed onto the support plate 3 by the displacement of the telescopic rail in the direction d. A subsequent displacement of the front end of the telescopic rail in the direction e effects a placing of the opening 26 onto the projection 21 configured as a latch nose. The opening 26 extends for this purpose in a manner not recognizable in FIG. 4 both at the lower surface and at the side surface of the lower part 2 of the telescopic rail 4. The telescopic rail is thus firmly fastened to the glass plate.

Figure 5:
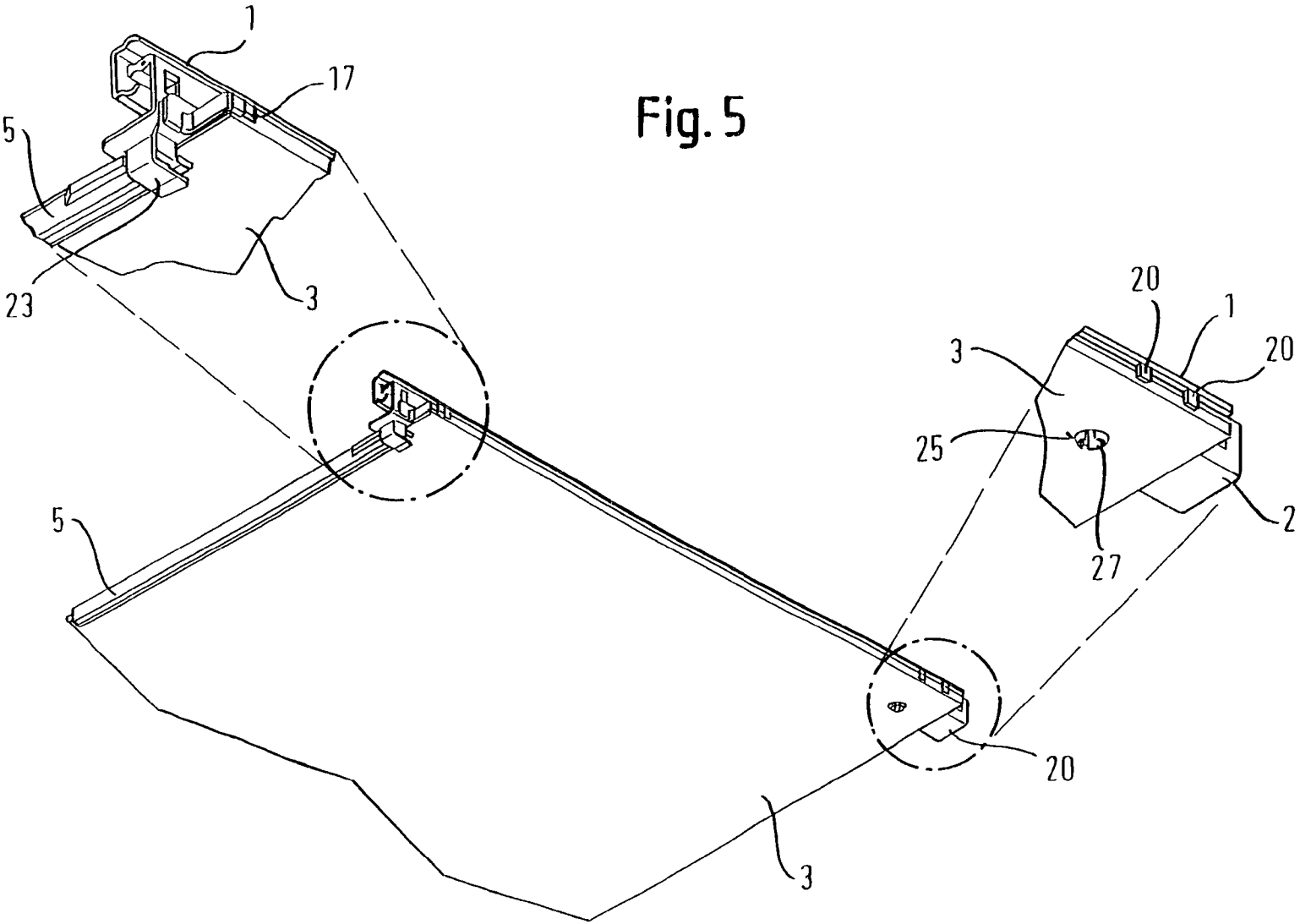
FIG. 5: a telescopic rail system in accordance with the invention in a view from below with two detailed views.

FIG. 5 makes clear how the individual fastening elements act on the glass plate 3. It can be recognized in the detailed drawing in the left hand part of FIG. 5 how the hook 23 surrounds the holding rail 5 and the glass plate 3. In the right hand detailed drawing of FIG. 5, latch noses 27 can be recognized which are arranged at the lower side of the holding element 19 and can be pushed through the opening 25 in the glass plate 3 in the manner of a snap-in closure. The abutments 20, which are formed at a side of the holding element 19, are additionally supported at the lateral edge of the support plate 3.

Figure 6:
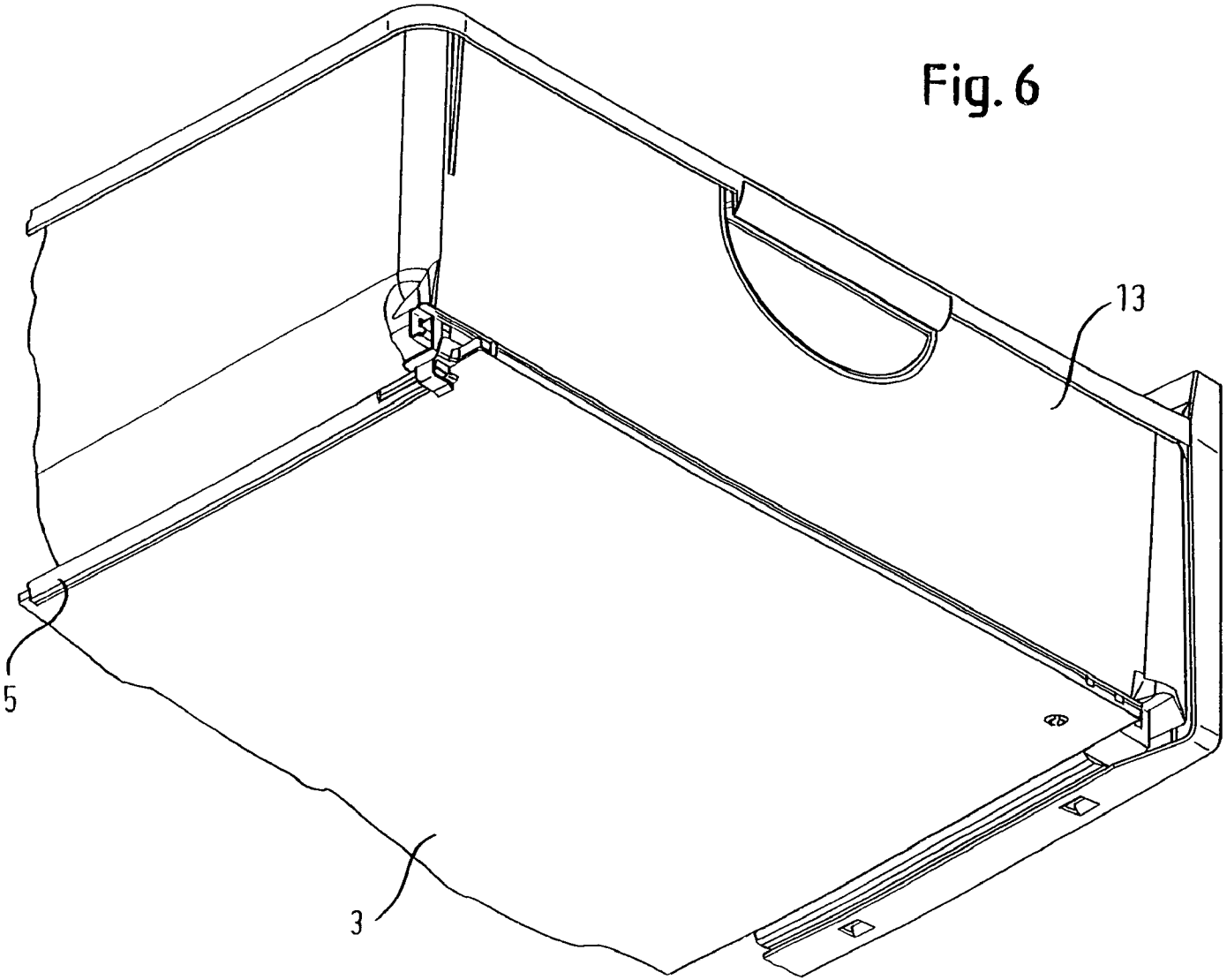
FIG. 6: a telescopic rail system in accordance with the invention comprising a drawer placed on in a view from below.

In FIG. 6, a support plate 3 is again shown from below, with a drawer 13 being placed onto the telescopic rail here.

The embodiment of FIGS. 1 to 6 is installed as follows: The holding rail 5 is first placed onto the rear edge of the glass plate 3. The holding element 19 is then latched to the plate at the front. The telescopic rail 4 is lowered onto the glass plate 3 in the direction c of FIG. 4 and is displaced in the direction d such that the hook-like element 23 in the recess 15 of the holding rail 5 engages around the support plate 3. Displacement of the telescopic rail in the direction e effects a placing of the opening 26 in the lower part 2 of the telescopic rail 4 onto the latch noses 21 of the holding element 19. In an analogous manner, a second telescopic rail is fastened to the oppositely disposed second part of the glass plate 3 which is not shown in the Figures. The drawer 13 can now be placed onto the telescopic rails. The total unit of the glass plate 3 and the telescopic rails latched thereon and the drawer is now pushed into the refrigerator unit and/or freezer unit into the rail 9 in the inner side wall 7 and is latched in optionally present latch devices.

The drawer 13 can now be pushed in and out easily with the aid of the telescopic rails. A direct contact of the drawer 13 with the glass plate 3 is avoided.

If maintenance should become necessary, the telescopic rail 4 can be removed from the glass plate 3 very easily so that the system in accordance with the invention proves to be very flexible.

With a corresponding configuration, the telescopic rail can also be used for other elements to be pushed in, e.g. for shelf plates to be pulled out. Turning the support plate 3 over has the effect that the telescopic rail 4 is no longer arranged above the support plate 3, but beneath it. With a corresponding configuration of the drawer, a draw can thus also be arranged beneath the support plate.

Figure 7:
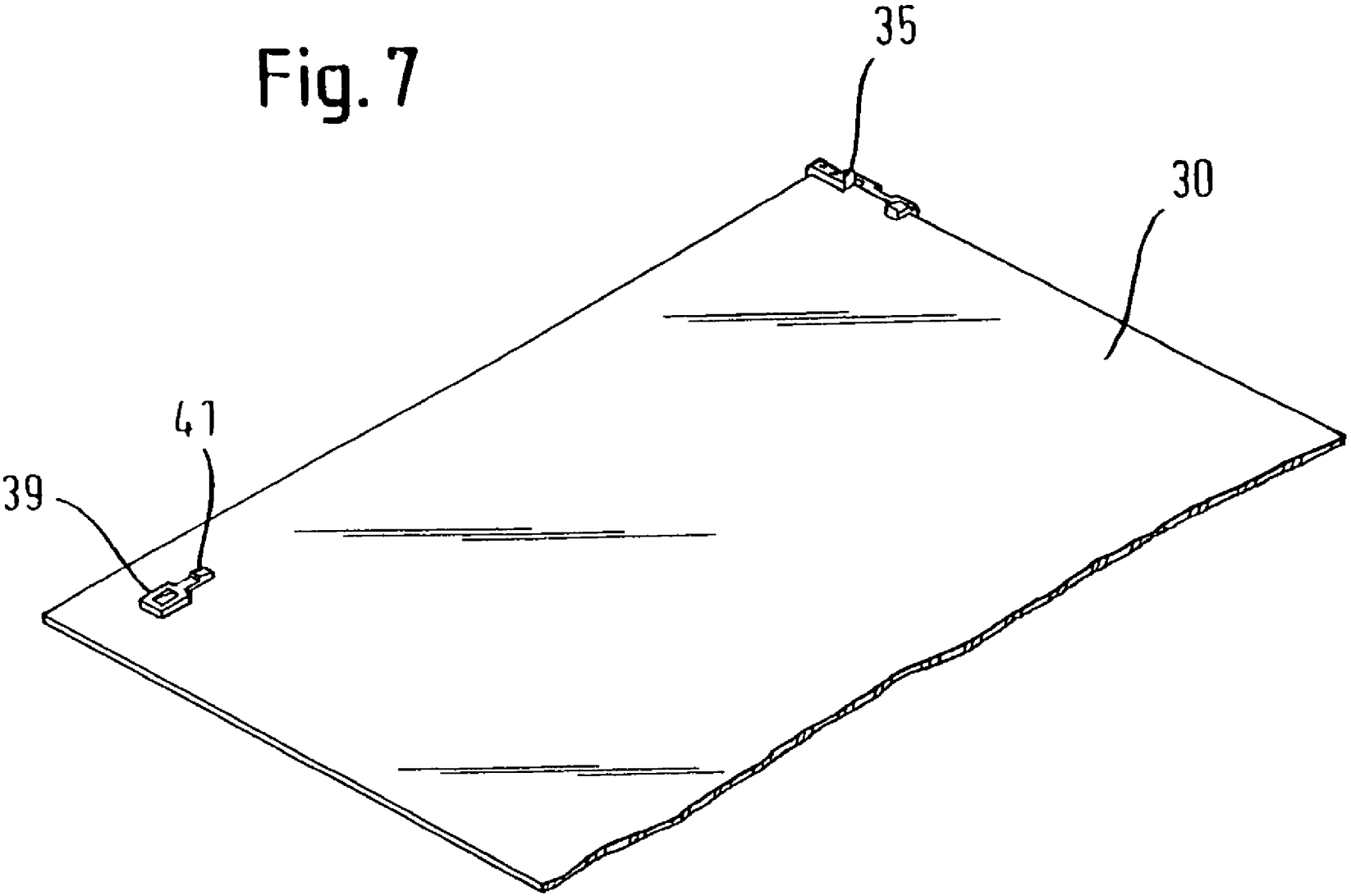
FIG. 7: a support plate of another embodiment in accordance with the invention.

FIG. 7 shows a further embodiment. Here, two holding rails 35 are provided at the glass plate 30, of which only the holding rail 35 is visible at an end of the glass plate 30 in the partial view of FIG. 7. A holding element 39 is pushed through a corresponding opening in the glass plate 30 in the front region of the glass plate 30. The holding element 39 can likewise comprise a downwardly facing latch nose in accordance with the latch nose 27 of the first embodiment such that the holding element 39 can be pushed through the glass plate in the manner of a snap closure.

Figure 8:
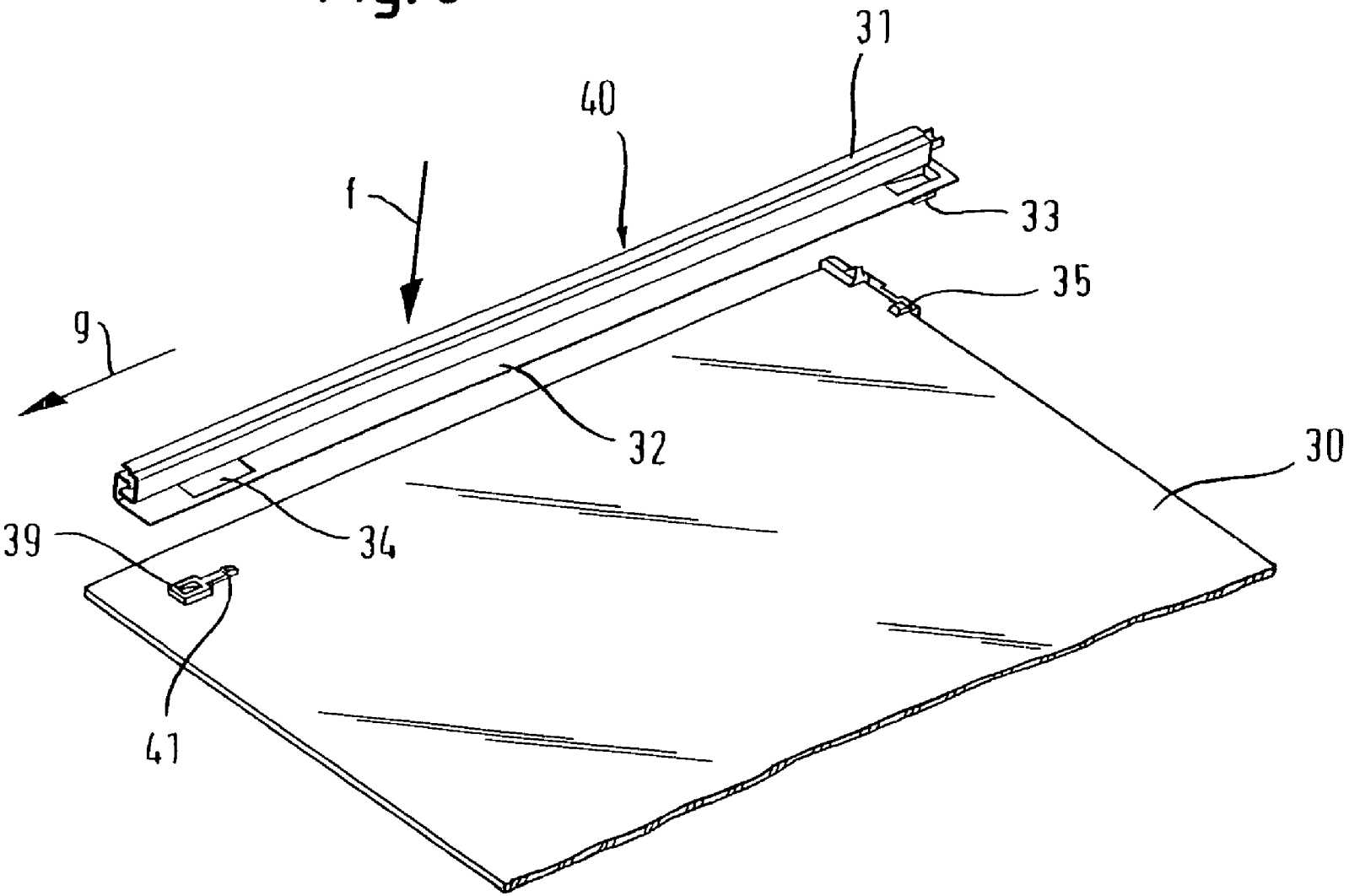
FIG. 8: the telescopic rail system of this embodiment during the installation.

The installation process of the telescopic rail 40 on the glass plate 30 and the interaction of the individual fastening elements are shown in FIG. 8. The holding element 39 has a rearwardly facing projection 41 which is spaced apart from the glass plate and with which an opening 34 in the lower region 32 of the telescopic rail 40 corresponds. The lower part 32 of the telescopic rail 40 has a downwardly hook-like element 33 in the rear region similar to the hook-like element 23 of the first embodiment.

The telescopic rail is first lowered onto the glass plate 30 in the direction f. The opening 34 also lowers over the holding element 39. Displacement in the direction d effects the hooking of the hook 33 into the recess of the holding rail 35.

On the displacement of the telescopic rail 40 in the direction g, the projection 40 moreover hooks into the opening 34. The telescopic rail 40 is fixedly fastened to the glass plate 30 in this manner. In an analogous manner, a second telescopic rail is fastened to the side of the glass plate 30 not shown in FIG. 8. As described for the first embodiment, a drawer can e.g. be placed onto the upper part 31 of the telescopic rail 40.

The described embodiments have separate holding elements and separate holding rails. In other embodiments, which are not shown, the holding rail and/or the holding elements form part of a plastic insert molding of the support plate. A further embodiment, which is not shown, comprises a support plate which is injection molded completely from plastic, with the holding rail and the holding elements being an integral component and being injection molded together with the support plate in one step. It is equally possible for the part of the telescopic rail which is fixed with respect to the support plate to be molded onto the support plate at the same time.

The invention claimed is:

1. A telescopic rail system, in particular for refrigerator units and/or freezer units, the refrigerator units and/or freezer units comprising a rear wall (11), a first side wall (7) and a second side wall, each of said first and second sidewalls including an upper rail and a lower rail, a drawer (13) placed on the upper rail being movable in a pulling out direction of the telescopic rail system away from the rear wall (11), the drawer (13) also being liftably removable from the rail system in a pulled out state, the telescopic rail system comprising:

a support plate (3, 30) for holding the telescopic rail system in the inner compartment of the refrigerator unit and/or freezer unit; wherein the support plate (3, 30) is configured for insertion into the lower rail of the first and second sidewalls and fastened thereto, two telescopic rails (4, 40), arranged directly on a top or bottom surface of a lateral region of the support plate (3, 30) adjacent to and parallel with the first and second sidewalls respectively, the telescopic rails (4, 40) each including a hook-like element (23, 33), at a first end, adjacent the rear wall (11) when the two telescopic rails (4, 40) are arranged directly on a top or bottom surface of a lateral region of the support plate (3, 30) the hook-like elements (23, 33) engaging the support plate (3, 30) by pushing the hook-like elements (23, 33) onto a first edge of the support plate (3, 30), at the rear edge in the refrigerator unit and/or freezer unit adjacent the rear wall (11)

at least one holding rail (5, 35) including a recess (15) which faces away from the support plate (3, 30), the telescopic rails (4, 40) being received in the recess (15) in a pushed in state such that the first end of the telescopic rails (4, 40) are secured against lateral slipping, projections (21, 41) provided at a second end of the supporting plate (3,30), corresponding to an end of the telescopic rail opposite the rear wall (11) to hold the telescopic rails (4, 40), wherein the projections (21, 41) are formed parallel to and spaced apart from the support plate (3, 30) and face perpendicular to the pulling-out direction, the telescopic rails (4, 40) have corresponding openings (26, 34), wherein the projections (21, 41) are configured for insertion as a snap closure into corresponding openings (26, 34) of the telescopic rails (4, 40).

2. A telescopic rail system in accordance with claim 1, wherein the telescopic rails (4, 40) are arranged at a surface of the support plate (3, 30).

3. A telescopic rail system in accordance with claim 1, wherein the telescopic rails (4, 40) are releasably arranged at the support plate (3, 30).

4. A telescopic rail system in accordance with claim 1, wherein the holding rail (5) comprises end abutments (17) which contact the lateral edges of the support plate (3) to secure the holding rail against lateral slipping.

5. A telescopic rail system in accordance with claim 1, comprising two holding rails (35) which can be placed at oppositely disposed ends of the first edge of the support plate (30).

6. A telescopic rail system in accordance with claim 5, wherein the two holding rails (35) each have an abutment which contacts the respective lateral edge of the support plate (30) in an installed state.

7. A telescopic rail system in accordance with claim 1, comprising holding elements (19, 39) which can be fastened to the support plate (3, 30) to hold the telescopic rails (4, 40).

8. A telescopic rail system in accordance with claim 7, wherein said end, the telescopic rails (4, 40) include a hook-like element (23, 33) which engages the support plate (3, 30) when secured onto a first edge of the support plate (3, 30), the telescopic rail system further said holding elements (19, 39) fastened to oppositely disposed sides of the support plate in the vicinity of a second edge of the support plate (3, 30) parallel to the first edge.

9. A telescopic rail system in accordance with claim 7, wherein the support plate has openings (25) for the fastening of the holding elements (19, 39) and the holding elements (19, 39) have latch noses (27) corresponding to the openings of the support plate which can be inserted into the openings (25) of the support plate.

10. A telescopic rail system in accordance with claim 7, wherein the holding elements (19) comprise abutments (20) which contact the lateral edge of the support plate (3) such that the respective holding element (19) is secured against lateral slipping.

11. A telescopic rail system in accordance with claim 1, further including the telescopic rails (4, 40) include a hook-like element (23, 33) which engages the support plate (3, 30) and positioned onto a first edge of the support plate (3, 30), and an insert molding comprising two holding elements which are arranged at oppositely disposed sides of the support plate in the vicinity of a second edge of the support plate parallel to the first edge.

12. A telescopic rail system in accordance with claim 1, wherein the support plate (3, 30) is glass.

13. A telescopic rail system in accordance with claim 1, wherein the support plate (3,30) is plastic.

14. A telescopic rail system in accordance with claim 13, wherein the support plate comprises integrally shaped holding elements to hold the telescopic rail.

15. A telescopic rail system in accordance with claim 14, wherein said holding elements the telescopic rails (4, 40) include a hook-like element (23, 33) which engages the support plate (3, 30) at a first edge of the support plate (3, 30) comprising two holding said holding elements are shaped at oppositely disposed sides of the support plate in the vicinity of a second edge of the support plate parallel to the first edge.

16. A telescopic rail system in accordance with claim 7, wherein the holding elements (19) comprise said projections (21) formed parallel to and spaced apart from the support plate (3) and face perpendicular to the pulling-out direction (d) and the telescopic rails (4, 40) have corresponding said projections (21).

17. A telescopic rail system in accordance with claim 16, wherein the projections (21, 41) are configured such that they can be inserted in the manner of a snap closure into the corresponding openings (26, 34) of the telescopic rails (4, 40).

18. A telescopic rail system in accordance with claim 1, wherein the telescopic rails (4, 40) are arranged above the support plate (3, 30).

19. A telescopic rail system in accordance with claim 1, wherein the support plate (3, 30) is configured for reception in rails (9) in the lateral regions (7) of the inner container of a refrigerator unit and/or freezer unit.

20. A telescopic rail system in accordance with claim 1, wherein the telescopic rail system supports a drawer (13).

21. A refrigerator unit and/or a freezer unit comprising an apparatus in accordance with claim 1.

* * * * *